United States Patent [19]

Nishimura

[11] Patent Number: 4,768,754

[45] Date of Patent: Sep. 6, 1988

[54] MANUAL HOIST WITH OVERLOAD PREVENTER

[75] Inventor: Yosaku Nishimura, Hirakata, Japan

[73] Assignee: Vital Kogyo Kabushiki Kaisha, Saka, Japan

[21] Appl. No.: 91,515

[22] Filed: Aug. 26, 1987

[30] Foreign Application Priority Data

Sep. 10, 1986 [JP] Japan ..... 61-213628

[51] Int. Cl.[4] ..... B66D 1/14; G05G 1/12

[52] U.S. Cl. ..... 254/351; 254/352; 254/357; 254/903

[58] Field of Search ..... 254/346, 347, 350, 351, 254/352, 357, 369, 348, 353, 354, 368, 903; 192/16, 93 A, 94

[56] References Cited

U.S. PATENT DOCUMENTS

| | | | |
|---|---|---|---|
| 3,741,527 | 6/1973 | Dahl | 254/350 |
| 3,776,514 | 12/1973 | Eggleton et al. | 254/369 X |
| 4,251,060 | 2/1981 | Suzuki et al. | 254/356 |
| 4,469,308 | 9/1984 | Nakamura et al. | 254/357 X |
| 4,474,360 | 10/1984 | Maeda | 254/357 X |
| 4,483,519 | 11/1984 | Nakamura | 254/350 |
| 4,512,555 | 4/1985 | Nakamura | 254/350 |
| 4,664,357 | 5/1987 | Nishimura | 254/357 X |

FOREIGN PATENT DOCUMENTS 202093 10/1985 Japan .

*Primary Examiner*—Stuart S. Levy
*Assistant Examiner*—Joseph J. Hail, III
*Attorney, Agent, or Firm*—Mason, Fenwick & Lawrence

[57] ABSTRACT

A manual hoist with overload preventer wherein rotation in the winding direction under overload is automatically arrested; however, when an overload develops after hoisting or pinching of a load, unwinding is possible. The apparatus includes an operation ring, and a friction ring and a drive ring both being capable of engaging the operation ring. When the driving ring is turned in the winding direction, the operation ring remains engaged with both the friction ring and the drive ring, enabling the relative rotation of the drive ring and the friction ring. When the drive ring is turned in the unwinding direction, the drive ring and the friction ring are rotated as a unit through the operation ring.

7 Claims, 4 Drawing Sheets

MANUAL HOIST WITH OVERLOAD PREVENTER

BACKGROUND OF THE INVENTION

1. Field of the Invention

This invention relates to a manual hoisting apparatus of the lever type or chain block type. More particularly, this invention relates to a manual hoisting apparatus such that the rotation in the hoisting or winding direction is automatically precluded under overload and that even when the apparatus is overloaded by an external force acting after hoisting or pinching of a load, the rotation of a drive ring is positively transmitted to a drive shaft to lower or release the load.

2. Description of the Prior Art

The conventional manual hoisting apparatus includes the one proposed by the present applicant and disclosed in Japanese Unexamined Patent Publication No. 60-202093.

The apparatus described in the above patent literature comprises a load sheeve rotatably supported by side plates constituting the body of the hoisting device and drive shaft rotatably mounted on said load sheave. This drive shaft is extending beyond the side plates supporting the load sheave. The portion of said drive shaft which extends from one of said plates is formed with a thread. Screwed onto this thread is a shaft driving member, to which a force exerting member is further threaded. Secured to the other projecting end of said drive shaft is a drive pinion which is arranged to drive the load sheave via a reduction gear train. The shaft driving member mentioned above has a boss extending towards said force exerting member. Rotatably mounted on said boss is a ratchet wheel which is flanked by friction disks. The ratchet wheel is engaged with an anti-reversal ratchet pawl in such a manner that it is rotatable only in the winding or hoisting direction. It should be understood that reference to the winding or hoisting direction refers to the direction in which any member rotates when sheave 3 is rotating in a winding or hoisting operation; conversely, reference to the unwinding direction of movement means the direction that any member rotates when the sheave 3 is unwinding for lowering its load.

Further, the above force exerting member carries a manual chain sprocket which is pressed by a conical friction ring at a predetermined pressure.

Thrown on said chain sprocket wheel is a manipulating chain and the load sheave is turned in the hoisting direction or the lowering direction via said sprocket wheel.

In the above conventional hoisting apparatus, if one attempts to hoist up a load under overload conditions, the torque applied to the ratchet wheel through said sprocket wheel, force exerting member and friction disk upon pulling of the chain is exceeded by the force pressing the force exerting member against the shaft driving member via said drive shaft owing to the overload, with the result that said sprocket wheel idles on the conical friction ring. Therefore, the hoisting of the overload in excess of the rating is automatically arrested.

To lower the suspended load, the sprocket wheel is turned in the unwinding direction to reduce the pressing force acting on the friction disk and to thereby rotate the drive shaft in the unwinding direction.

In the above arrangement, however, in the situation where the hoisting apparatus is used for pinching the truck load and the operation is carried out within the rating, the load sheave may be subjected to an unexpected overload owing to the vibrations of the truck or a sudden displacement of the truck load or owing to an external force that may act on the suspended load. In such an event, the force applied by the load sheave to rotate the drive shaft causes the force exerting member to be pressed hard against the friction disk.

Therefore, even if the sprocket wheel is turned in the unwinding direction to drive the load sheave in the unwinding or loosening direction, the torque exerted by said friction disk to arrest rotation of the force exerting member exceeds the torque applied to said sprocket wheel, with the result that the sprocket wheel idles with respect to the conical friction ring, thus preventing the unwinding (loosening) rotation of the load sheave. Therefore, once such a situation develops, it is time-consuming and troublesome for the operator to take the load off.

BRIEF SUMMARY OF THE INVENTION

It is a primary object of this invention to provide a novel manual hoisting apparatus of the lever type or chain block type which is free of the above disadvantages of the prior art apparatus.

It is another object of this invention to provide a manual hoisting apparatus such that the drive wheel such as the sprocket wheel idles to automatically stop hoisting of a load.

It is a still another object of this invention to provide a manual hoisting apparatus such that even when it is overloaded by an unexpected external force acting after hoisting or pinching of a load, the rotation of the drive wheel can be transmitted to the drive shaft via the operation wheel, thus permitting an unwinding operation.

The manual hoisting apparatus according to this invention comprises a load sheave, a drive shaft mounted on said load sheave, a shaft driving member secured to said drive shaft, an anti-reversal ring rotatable only in one direction is rotatably mounted on said drive shaft, a force exerting member threaded onto said drive shaft and adapted to press said anti-reversal ring firmly against said shaft driving member on rotation in the winding direction, a friction ring disposed on the opposite side of said force exerting member with respect to said shaft driving member and adapted to move in the axial direction relative to said force exerting member but be unable to turn in a circumferential direction, a drive ring interposed between said force exerting member and friction ring, a biasing means interposed between said friction ring and force exerting member and adapted to press said drive ring at a predetermined pressure, an operation ring disposed rotatably with respect to said drive shaft, said operation ring having an engaging means, said friction ring having an engaging means which is engageable with said engaging means of said operation ring, said drive ring having an engaging means engageable with the engaging means of said operation ring, and when said drive ring is turned on the winding direction with said engaging means remaining engaged with the engaging means of said friction ring and the engaging means of said drive ring, said drive ring and friction ring are relatively rotatable whereas when said drive ring is turned in the unwinding direction, said drive ring and friction ring are rotatable as a unit through said engaging means.

The other objects and features of this invention will become apparent from the following detailed description made with reference to the accompanying drawings and from the new matter pointed out in the appended claims.

DETAILED DESCRIPTION OF THE PREFERRED EMBODIMENT

Figure 1:
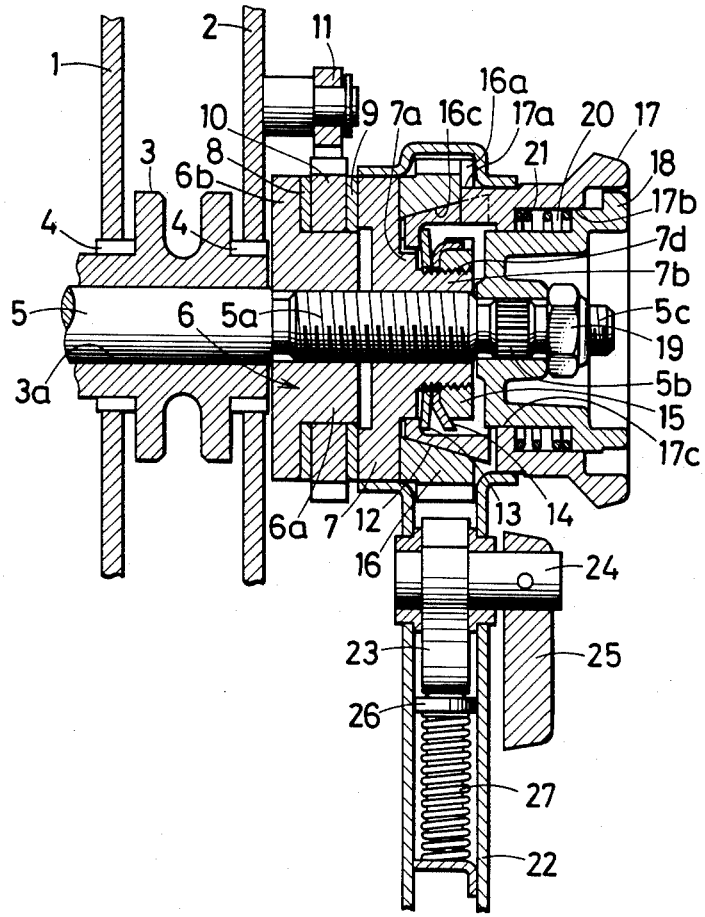
FIG. 1 is a longitudinal cross-section view showing the cardinal part of a lever-type hoist embodying the invention.

Referring to FIG. 1, a load sheave 3 is rotatably supported through bearings 4, 4 in the center between side plates 1 and 2 disposed in parallel with a predetermined spacing. This load sheave 3 is centrally provided with a shaft hole 3*a* through which a drive shaft 5 is a extending.

Both ends of said drive shaft 5 project outwards beyond the load sheave 3 and the outer circumference of one projecting end of said drive shaft 5 is formed with a thread 5*a*, a spline 5*b* and a reduced-diameter thread 5*c* in the order of progressively reducing diameter from the near to the far side with respect to said side plate 2. The thread 5*a* mentioned above is a thread having a large pitch.

Though not shown in the drawings, the other projecting end of said drive shaft 5 is connected to a pinion gear with which said load sheave 3 is associated for driving through a reduction gear train.

Threaded on the thread 5*a* of said drive shaft 5 are a shaft driving member 6 and a force exerting member 7 in the order mentioned from the near to the far side with respect to said side plate 2.

The shaft driving member 6 has been threaded on said thead 5*a* as far as it goes. The shaft driving member 6 is formed with a boss 6*a* projecting towards said outwardly located force exerting member 7 and a disk portion 6*b* around said boss 6*a*. This boss 6*a* supports a pair of friction members 8 and 9 and an anti-reversal ring in the form of a ratchet wheel 10 interposed therebetween.

The said ratchet wheel 10 constitutes an anti-reversion wheel capable of turning only in one direction. The ratchet wheel 10 and the friction members 8, 9 disposed on both sides thereof are pressed against the disk portion 6*b* of the shaft driving member 6 by the force exerting member 7 juxtaposed with said shaft driving member 6.

Indicated at 11 is a ratchet pawl pivotally supported by said side plate 2 which engages said ratchet wheel 10 to permit selective rotation of the wheel 10 in the winding direction of the load sheave 3.

Figure 8:
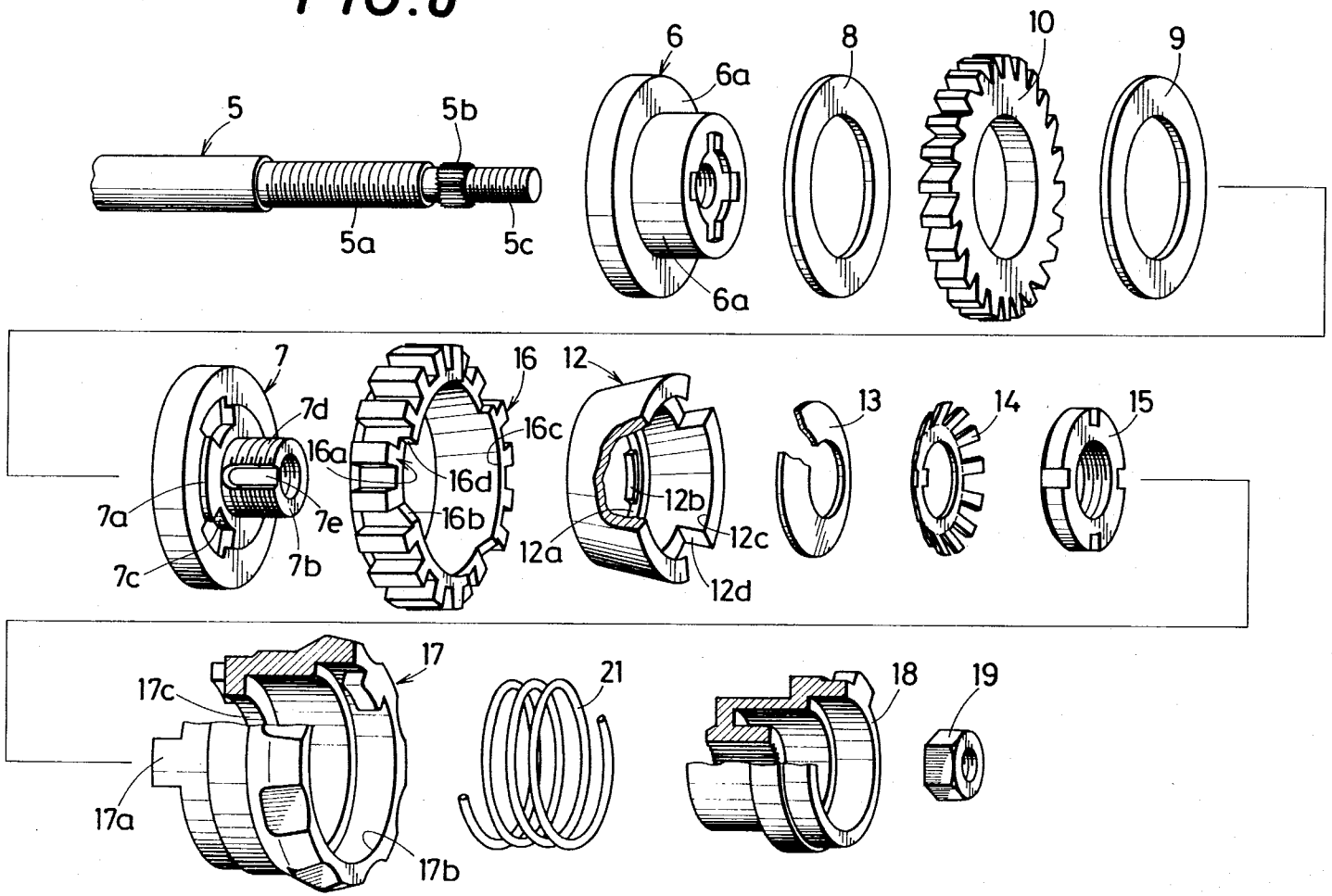
FIG. 8 is a disassembled perspective view showing the same hoist.

The force exerting member 7 is formed with a first large-diameter boss 7*a* and a second small-diameter boss 7*b* on the opposite side with respect to said shaft driving member 6. As shown in FIG. 8, the first boss 7*a* is circumferentially formed with a plurality of recesses 7*c* at equal intervals. The second boss 7*b* is formed with a thread 7*d*.

Figure 4:
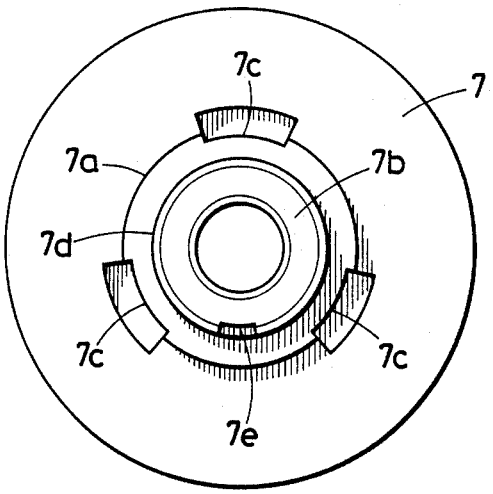
FIG. 4 is a plan view showing the force exerting member of the same hoist as viewed from the boss side.
Figure 5:
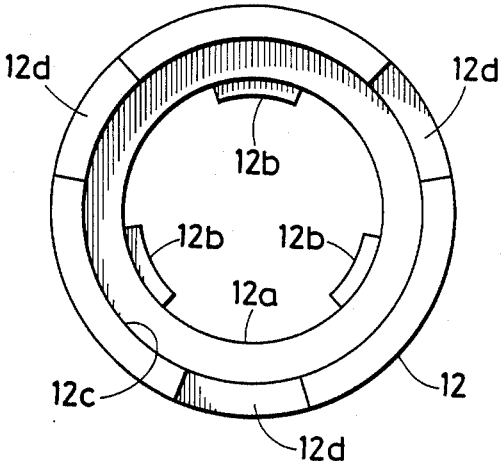
FIG. 5 is a plan view showing the conical friction ring of the same hoist as viewed from the larger end side thereof.

Each of the recesses 7*c* . . . of said force exerting member 7 is engaged by one of projections 12*b* . . . of the conical friction ring 12, with the projection 12*b* projecting inwardly from a through hole 12*a* of said conical friction ring 12. The recesses 7*c* . . . of said force exerting member and the projections 12*b* are capable of relative movement in the axial direction only and are locked against movement in the circumferential direction [FIGS. 4 and 5].

As shown in FIG. 8, the diameter of the conical friction ring 12 increases with an increasing distance from the force exerting member 7 and the increased-diameter end of the conical friction ring is formed with a cavity 12*c*.

A disk spring 13 is set on the second boss 7*b* of the force exerting member is installed within said cavity 12*c*, with the outer periphery of said disk spring 13 abutting the bottom of said cavity 12*c*. The dish spring 13 is secured in position by a nut 15 which is screwed onto a thread 7*d* of said second boss 7*b* through a washer 14 contacting the inner periphery of said dish spring 13.

At the forward end (the reduced-diameter end) of said conical friction ring 12, there is interposed a drive gear 16 formed as a drive ring with a conical inner surface defining a through hole 16*c*. The aforementioned dish spring 13 presses the lateral surface of the drive gear 16 through said conical friction ring 12 towards the force exerting member 7 at a predetermined force.

The pressing force exerted by said dish spring 13 can be adjusted with said nut 15. Thus, the washer 14 is held against rotation in a groove 7*e* formed in the second boss 7*b* of the force exerting member (FIG. 8) and the peripheral projections of said washer 14 are bent to engage the plurality of recesses.

The large-diameter end of said conical friction ring 12 is formed with not less than one ring-engaging cutout 12*d*. The cutout 12*d* is such that both sides thereof in the circumferential direction are at substantially right angles with the end edge of the ring and reaches into the bore of the drive gear 16.

In contrast, said drive gear 16 is formed with a trapezoidal cutout 16*a* in the position corresponding to the cutout 12*d* of the conical friction ring 12. As shown in FIG. 8, this cutout 16*a* is formed in such a manner that its forward side in the winding direction is at substantially right angles with the end edge of the ring and the rear side thereof is constituted by an inclined wall 16*b* defining a space expanding towards the end edge.

Facing the conical friction ring 12 and drive gear 16 is an operation ring 17 which is provided with engaging means in the form of a projection 17*a* adapted to fit into said cutouts 12*d* and 16*a*.

It is understood that the geometric relation of the projection 17*a* of said operation ring with the cutout 12*d* of said friction ring and the cutout 16*a* of said drive gear may be reversed.

The operation ring 17 is centrally formed with a circular cavity 17*b* and a through cavity 17*c* of reduced diameter. This through cavity 17*c* accepts a spring retainer 18 engaged by the spline 5*b* of said drive shaft 5 and the operation ring 17 is free to turn on the outer periphery of said spring retainer 18.

Indicated at 19 is a nut threaded onto the reduced-diameter thread 5*c* of said drive shaft 5. This nut 19 serves to prevent disengagement of said spring retainer 18 from the drive shaft 5.

The aforementioned spring retainer 18 is increased in outer diameter towards its outer end and fits into the inner circumferential surface of the cavity 17*b* of said operation ring 17 to form a closed annular space 20 between it and said operation ring 17. The operation ring 17 engaged with the spring retainer 18 is pressed towards the drive gear 16 by a spring 21 loaded in said annular space 20.

Disposed as surrounding the drive gear 16 on the circumference of said force exerting member 7 and operation ring 17 is an operating lever 22 which is freely rotatable about the drive shaft 5.

Indicated at 23 is a switching pawl housed in the operating lever 22. In response to the switching operation of a handle 25 secured to a shaft 24 projecting out from the operating lever 22, this switching pawl 23 effects the engagement and disengagement with the drive gear 16 in the winding and unwinding directions.

Figure 2:
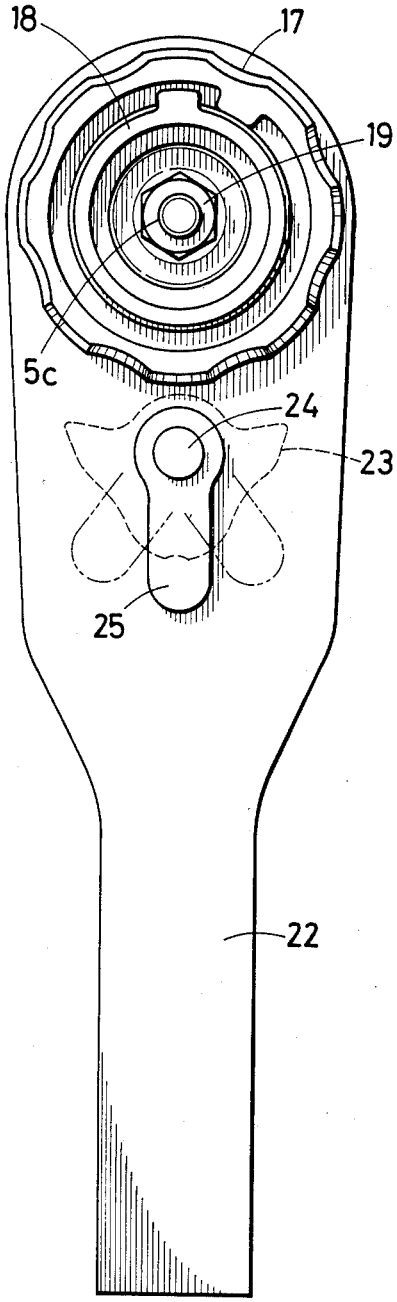
FIG. 2 is a front view showing the same hoist as viewed from the operating lever side.
Figure 3:
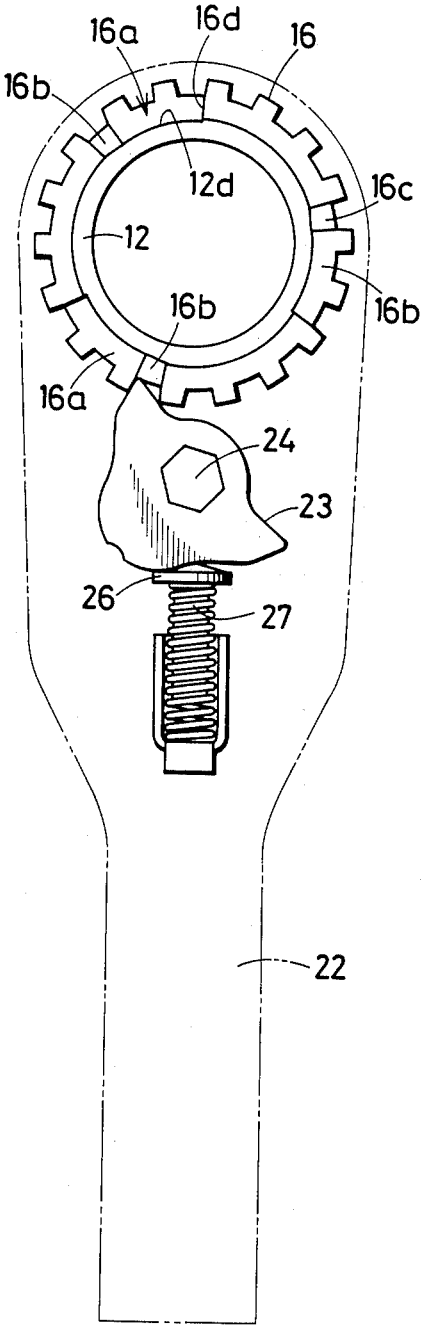
FIG. 3 is a front view showing, in partial section, the association between a drive gear and a switching pawl in the same hoist.

Thus, FIGS. 1 and 2 show the disengaged state of the switching pawl 23. As the handle 25 is turned clockwise from the position indicated by solid lines in FIG. 2 to the position indicated by two dot-broken lines in FIG. 2, the switching pawl 23 is engaged with the drive gear 16 to rotate the drive gear 16 in the winding direction as shown in FIG. 3. On the other hand, as the handle 25 is turned counterclockwise from the position indicated by solid lines to the position indicated by two dots-broken lines in FIG. 2, the switching pawl 23 is engaged with the drive gear 16 in such a manner that the drive gear 16 is rotated in the unwinding direction.

The reference numeral 26 represents a biasing member built into the operating lever 22. This biasing member 26 is constantly pressed against the switching pawl 23 by a spring 27, whereby the switching pawl 23 turned by the handle 25 to a given position is retained in that position. The functions and effects of the embodiment are explained below.

(A) Winding operation within the rated load range.

The switching pawl 23 is engaged with the drive gear 16 to rotate the gear 16 in the winding direction and, then, the operating lever 22 is turned in reciprocation. Then, within the rated load range, the conical friction ring 12 is frictional association with said drive gear 16 revolves together with the drive gear as a unit and, further, rotates the drive shaft 5 in the winding direction (clockwise direction) through the force exerting member 7 in spline connection therewith by the projection and recesses 12*b*, 7*c* . . . , so that via the gear train not shown, the load sheave 3 is turned in the same direction as the drive shaft 5 to wind up the load within the rated range.

(B) Winding operation under overload conditions.

When the load acting on the load sheave 3 is an overload, an attempt to wind up the load by reciprocation of the operating lever 22 results in slippage between them as the torque required for driving the drive gear 16 is larger than the frictional force acting between the conical friction ring 12 and drive gear 16.

Figure 7:
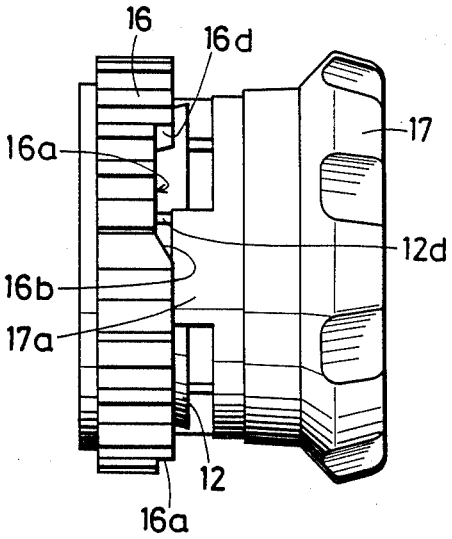
FIG. 7 is a plan view showing the pattern of engagement where the drive gear of the same hoist idles with respect to the conical friction ring and operation ring.

Moreover, when the drive gear 16 is rotated by the operating lever 22 in the winding direction, the operation ring 17 engaged with the cutout 12*d* of the conical friction ring 12 and the cutout 16*a* of the drive gear 16 is pushed out to the position contacting the lateral surface of the drive gear 16 against the biasing force of the spring 21 as its projection 17*a* slides on the inclined side 16*b* of the cutout 16*a* (to the right in FIG. 1), with the result that it is released from the engagement with the drive gear 16 as shown in FIG. 7.

Therefore, even if the operating lever 22 is reciprocated under an overload, the drive gear 16 released from the engagement with the operation ring 17 does idling with respect to the conical friction ring 12 to automatically prevent damage to the apparatus due to hoisting of an overload.

(C) Unwinding operation.

On the other hand, when the switching pawl 23 is switched to the unwinding direction and the operating lever 22 reciprocated, the drive gear 16 engaged by the switching pawl 23 is rotated in the unwinding direction (counterclockwise direction).

When the load on the load sheave is less than the rating, there occurs no slippage between the drive gear 16 and the conical friction ring 12 so that the rotation of the direction of loosening the force exerting ring 7 may take place.

Further, if the load becomes excessive so as to overload the load sheave side, this overload causes rotation of the drive shaft and, accordingly, the shaft driving member 6, with the result that the drive gear slides on the conical friction ring 12.

Figure 6:
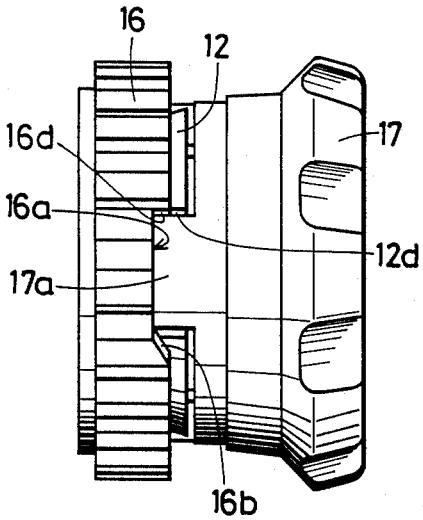
FIG. 6 is a plan view showing the pattern of engagement where the conical friction ring, drive gear and operation ring of the same hoist are driven as a unit.

Then, the projection 17*a* of said operation ring 17 engages the perpendicular face 16*d* of the cutout 16*a* of the drive gear 16 which lies in the winding direction. And as the drive gear 16 is thereby rotated in the unwinding direction, the operation ring 17 is also rotated in the same direction (FIG. 6).

When the operation ring 17 is out of engagement with the drive gear 16 as shown in FIG. 7, the rotation of the drive gear 16 and the consequent shift of the cutout 16*a* to the position facing the projection 17*a* causes the operation ring 17 kept pressed by the spring 21 to move towards the drive gear 16. As a result, the projection 17*a* of the operation ring 17 engages the cutout 16*a* of the drive gear 16 as shown in FIG. 6 and thereafter, the operation ring 17 is rotated in the same direction as the drive gear 16.

Since the projection 17*a* of said operation ring 17 has been engaged by the cutout 12*d* of the conical friction ring 12, the rotation of the operation ring 17 in association with the drive gear 16 as a unit causes the operation ring 17 to drive the conical friction ring 12 engaged by the projection 17*a* in the unwinding direction.

Therefore, the force exerting member 7 spline-coupled to the conical friction ring 12 is shifted away from the friction member 9, thus ceasing to press the friction member 9.

The shaft driving member 6 thus relieved of the frictional engagement with the ratchet wheel 10 is turned along with the drive shaft 5 by the load acting on the load sheave 3 in the direction of lowering the load (unwinding direction).

The drive shaft 5 is rotated until the force exerting member 7 has pressed the friction member 9 again and the load is moved in the unwinding direction during the intervening period.

Therefore, even if the machine is overloaded as an accidental force acts on the suspended load which, as such, is within the rated load range, or by a rolling vibration of the truck in the situation where the machine is used in the loading of the truck, one may turn the drive gear 16 in the unwinding direction with the operating lever 22 to shift the suspended load downwards or loosen the overload acting on the load sheeve 3.

It will be apparent from the above description that the present invention provides a very useful manual hoist offering the following advantages.

(1) In hoisting an overload, the drive gear is released from the operation ring to idle and thereby automatically stop lifting the load.

(2) Even if the machine is overloaded by an external force after hoisting or tightening of the load, the rotation of the drive gear can be transmitted to the drive shaft via the operation ring so as to effect unloading.

Thus, as the drive ring is turned in the unwinding direction by reciprocating the operating lever, for instance, the operation ring is engaged with the drive gear to turn the force exerting member away from the friction member, with the result that the load sheave is easily rotated in the unwinding or load loosening direction.

The above explanation pertains to the embodiment wherein the drive ring is a drive gear but the drive ring may be a manual sprocket wheel.

The embodiment specifically described in the foregoing detailed description is only intended to illustrate this invention and many changes and modifications may be made by those skilled in the art without departing from the spirit and scope of this invention which is only delimited by the appended claims.

What is claimed is:

1. A manual hoist with overload preventer comprising a load sheave, a drive shaft mounted on said load sheave, a shaft driving member fixedly secured to said drive shaft, an anti-reversal ring including means allowing rotation in only in one direction and rotatably mounted on said drive shaft, a force exerting member threaded onto said drive shaft for pressing said anti-reversal ring against said shaft driving member during rotation in a winding direction, a friction ring disposed on the opposite side of said force exerting member with respect to said shaft driving member and adapted to move in the axial direction relative to said force exerting member but including means prohibiting turning in a circumferential direction relative to said force exerting member, a drive ring interposed between said force exerting member and said friction ring, a biasing means interposed between said friction ring and said force exerting member and adapted to press said drive ring at a predetermined pressure, an operation ring disposed rotatably with respect to said drive shaft, said operation ring having an engaging means, said friction ring having an engaging means which is engageable with said engaging means of said operating ring, said drive ring having an engaging means engageable with the engaging means of said operation ring, and when said drive ring is turned in the winding direction with said engaging means of said operation ring remaining engaged with the engaging means of said friction ring and the engaging means of said drive ring, said drive ring and friction ring are relatively rotatable whereas when said drive ring is turned in the unwinding direction, said drive ring and friction ring are rotatable as a unit through said engaging means of said operation ring.

2. An apparatus according to claim 1, wherein said engaging means of said operation ring is a projection while said engaging means of said friction ring and said engaging means of said drive ring are each a cutout and both circumferential sides of the cutout of said friction ring are substantially perpendicular to the end edge of said friction ring and extending into said drive means while the cutout constituting said engaging means of said drive ring is configured as a trapezoid whose leading side in the winding direction is substantially perpendicular to the trailing side, with said trailing side being defined by an inclined side wall flared toward the end edge side.

3. An apparatus according to claim 1, wherein said anti-reversal ring is a ratchet wheel.

4. An apparatus according to claim 1, wherein said friction ring and said force exerting member are spline-coupled so that they are relatively movable in the axial direction but unable to rotate relatively in the circumferential direction.

5. An apparatus according to claim 1, wherein said friction ring is configured as a cone whose outer diameter increases in the direction away from said force exerting member with the force exerting member having an inner surface constituting a conical surface capable of frictional engagement with the peripheral surface of said friction ring.

6. An apparatus according to claim 1, wherein said biasing means is disposed on said drive shaft and comprises a dish spring in contact with said friction ring, a washer contacting the inner circumferential end of said dish spring and a pressure-setting nut threaded onto said drive shaft.

7. An apparatus according to claim 1, wherein said drive ring is a drive gear which is driven by a lever.

* * * * *